United States Patent [19]

Lottner

[11] 4,440,186

[45] Apr. 3, 1984

[54] NONSKID ASSEMBLY FOR PREVENTING THE SLIDING OF AN ITEM

[76] Inventor: Josef Lottner, Eburonenstrasse 9-11,, D-5000 Koln 1, Fed. Rep. of Germany

[21] Appl. No.: 344,153

[22] Filed: Jan. 29, 1982

[30] Foreign Application Priority Data

Jan. 29, 1981 [DE] Fed. Rep. of Germany ..... 3102868
May 5, 1981 [DE] Fed. Rep. of Germany ..... 3117614

[51] Int. Cl.[3] ..... A61H 3/02
[52] U.S. Cl. ..... 135/84
[58] Field of Search ..... 135/84

[56] References Cited

U.S. PATENT DOCUMENTS 108,303 10/1870 Tuttle ..... 135/84
765,984 7/1904 Morris et al. ..... 135/84
1,464,057 8/1923 Bell ..... 135/86 X
3,099,103 7/1963 Wright ..... 248/188.8
3,199,886 8/1965 Dover ..... 135/84 X
4,141,375 2/1979 Tykwinski ..... 135/84 X

FOREIGN PATENT DOCUMENTS 341874 10/1921 Fed. Rep. of Germany .
1373593 11/1974 United Kingdom .

*Primary Examiner*—William H. Grieb
*Attorney, Agent, or Firm*—Neil F. Markva

[57] ABSTRACT

The invention relates to a nonskid assembly comprising a tread carrier secured to a basic body which is connected to the lower end of the stick of a walking aid. A ball joint has a hollow ball cup situated in the axial central opening of a ring and is composed of supplementary sectional ball cup profiles at one end of the central opening and a plug is inserted at the front surface in the other end of the central opening and fixed in it. The ball has a shaft projecting out of the curved end of the central opening of the ring. The shaft is secured in a bore of a connecting piece.

38 Claims, 10 Drawing Figures

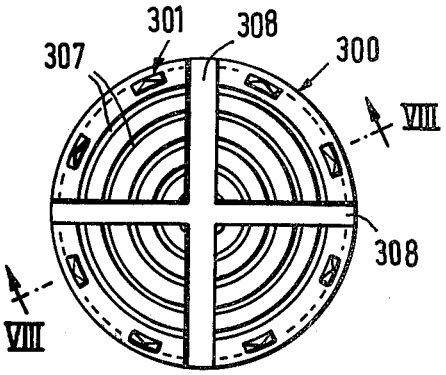
FIG.7
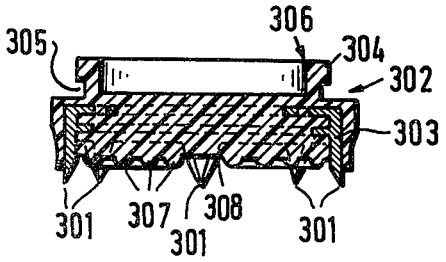
FIG.8
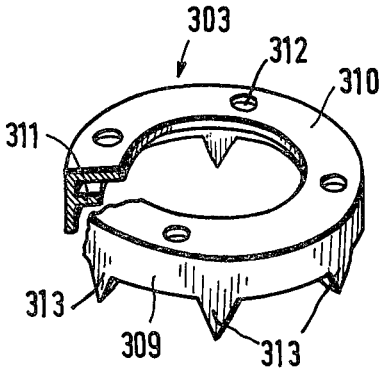
FIG.9
FIG.10
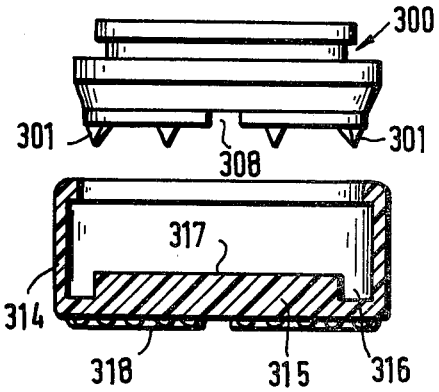

NONSKID ASSEMBLY FOR PREVENTING THE SLIDING OF AN ITEM

BACKGROUND OF THE INVENTION

The invention relates to a nonskid body comprising a tread carrier secured to a basic body which is connected to the lower end of the stick of a walking aid via a ball joint whose hollow ball cup is situated in the axial central opening of a ring and is composed of supplementary sectional ball cup profiles at one end of the central opening as well as of a plug inserted at the front surface in the other end of the central opening and fixed in it, the ball having a shaft projecting out of the curved end of the central opening of the ring and being secured in a bore of a connecting piece.

In a known nonskid body having a ball joint (German Pat. No. 341 874) the ball consists of two semispherical cup portions urged by a spring into opposite directions. A shaft extending from the cavity of the one cup portion and through the opening of the other cup portion is connected to the basic body. The hollow ball cup for housing the ball is designed at one end of a sleeve and separated via a constriction from a cylindrical part of the sleeve secured to the stick.

It is an essential disadvantage of the construction that, when pressure is exerted vertically in downward direction on the stick its lower end moves downwardly relative to the ball thus causing the latter to spread the constriction of the sleeve so that the ball may be displaced upwardly in the sleeve. The ball loses its firm fit in the hollow ball cup and is no longer firmly supported in the enlarged hollow ball cup. Such a loose support of the ball in its socket is most dangerous for the user of the stick because the frictional connection between the stick and the nonskid body suddenly fails and the only loose relation between said elements may give rise to the escape of the stick in oblique direction and to a probable fall of the user of the stick. In addition, with such an oblique escaping of the stick the ball may come off the shaft; at least, cracks may be formed which, later on, may result in a break. It is also disadvantageous that by the lifting of the ball in the hollow ball cup, its inside is accessible to dust, dirt and water penetrating into the hollow ball cup and affecting the operation of the ball joint or even rendering it completely inoperative. In the course of time, due to dust and dirt, the ball and hollow ball cup surfaces will get rough and lose their sliding ability, while in frozen condition, water will damage or block completely the ball joint.

Furthermore, because of its design of deformable semicups and its fixture by screws with the carrier element, the nonskid body is not very robust. The assembly of the nonskid body and its connection to the stick and to the basic body are complicated and involved. A dismantling of the nonskid body for inst. for cleaning or for the exchange of pieces is not easily possible. Due to its construction, the price of the nonskid body is inappropriately high for the intended use.

The above disadvantages can be also met with the known nonskid body of the foregoing type according to British Pat. No. 13 73 593. In case of said nonskid body, the basic body connected to the tread carrier contains the bore for housing the shaft of a one-part ball, the ring supporting the ball forming the connecting element to connect the nonskid body to a stick. Thus, from the nonskid body the ball projects upwardly, and its support in the central opening of the ring is ensured by a plug, a Belville spring washer, a stopper and a rib. The tread carrier connected to the basic body consists of two elements movable relative to one another, of which one serves as a slide whose sliding surface normally projects beyond the flat nonskid surface of a braking member. Only with the increasing weight of the body supported by the stick, a spring is compressed between the slide and the braking member which is pressed out of the slide to prevent the stick from slipping away from the user. The only occasional antiskid effects of the known nonskid body rendering it unsuitable, for safety purposes, for a walking stick or a crutch, on the one hand, and its ball joint design does not offer the required safety for the intended purpose, on the other hand.

If a pressure in vertically downward direction is exerted on the stick, its lower end moves downwardly relative to the ball thus compressing the spring washer, while the ball is displaced upwardly in the central opening of the ring. The ball is deprived of its firm abutment against the sectional ball cup profile of the ring and its support in the spread apart hollow ball cup is not firm any longer. This may cause a sudden fall of the user because his stick may suddenly escape in oblique direction. The ball may come off the shaft or cracks may form at least which result in a later rupture. By the lifting of the ball in the ring the central opening will be accessible to the penetration of dust, dirt and water into the hollow ball cup and the ball joint may be damaged or rendered inoperative. The great number of constructional elements of the nonskid body contribute to its expensive manufacture and to the difficulty of exchanging or cleaning its elements.

Starting from a nonskid body according to British Pat. No. 13 73 593, it is the object of the invention to provide a nonskid body which is robust and whose ball joint connection with the stick of the walking aid will reliably withstand for a long time all forces developing in practice. In addition, by a simple construction it shall be producible at a reasonable price, its assembly and disassembly shall be easy and its design shall be robust.

SUMMARY OF THE INVENTION

The nonskid assembly comprises a connecting piece which receives the shaft of a ball which is connected to the item to which a nonskid tread is to be attached. Further, the basic body portion is formed of a ring element having a central opening. A plug is inserted into the central opening from below. The plug has a plane underside which extends in alignment with the underside surface of the ring element. That is, the outer end surface of the plug is coextensive with the underside surface of the ring element when the plug is in place to hold the ball within the central opening of the ring element. A tread carrier is slipped on the ring element and mounted against the outer end surface of the plug and coextensive underside ring surface.

In the nonskid assembly of this invention, the ball is directed downwardly and reposes in a socket supported against the ground. Regardless of the load on the stick and of the stick angle relative to the nonskid body portion, no force whatsoever will be able to release the ball in the rigid hollow ball cup formed by the ring and plug.

In the capsule enclosing it firmly the ball is housed to be dustproof and protected from the penetration of liquid. Even after a long use the ball joint will perfectly operate without an undesired clearance. The assembly of the nonskid body is simple during its manufacture as well as upon a disassembly for maintenance or exchange of spare part purposes. To assemble the unit, it is only necessary to introduce the ball into the central opening of the ring so that its shaft protrudes through the end enclosed by the reduced border of the central opening of the ring. Subsequently the opposite end of the central opening is to be closed by the plug to complete the bearing cup. The shaft of the ball is then connected to the connecting piece for the stick. With the tread carrier over the lower end of the ring the nonskid assembly is completed and connected to a stick via the ball joint. Due to its construction of a few robust, simple elements and its non-complicated possible assembly, the nonskid assembly can be produced at a reasonable price. Its height is low and does not cause any troubles on a walking stick or a crutch.

In an advantageous embodiment of the invention, the plug is screwed into the central opening of the ring and protected against unscrewing. Thus, the assembly or dismantling of the nonskid assembly is additionally simplified. Moreover, the plug screwed into the central opening of the ring permits to retighten the ball seat to compensate wear or to meet with requirements of the user.

To improve the seat of the ball in the hollow ball cup, a groove housing is located at the inner end of the sectional ball cup profile in the central opening of the ring. A rubber-elastic sealing ring contacting the ball periphery is disposed in the groove housing.

At least the plug may be made of self-lubricating material. Alternatively, an axial opening for lubrication can be fitted in the center of the sectional ball cup profile of the plug.

At the shaft near the ball at a slight distance thereto, an annular collar forms a stop in the connecting piece. The diameter of the stop is inferior to that of the reduced end of the central opening of the ring so that it will pass through said opening. The annular collar determines the inserting depth of the shaft in the connecting piece and, in connection with the diameter of the opening of the reduced border of the ring, it defines the angular range of the relative movement between the nonskid body portion and the stick.

In one embodiment, the ring includes an edge flange overengaged by an inwardly directed edge of a cap-shaped tread carrier. As a result, the elements firmly cling together in use. However, to exchange the worn tread carrier, the elements can be easily separated from each other by undoing their catching engagement.

To further improve the connection between the ring and the tread carrier, in another embodiment of the invention, the undersurface of the ring includes an annular groove having an inner wall and an outer wall. The outer wall includes a marginal flange facing the opposite inner wall of the groove. A hollow tread carrier extension has a profile adapted to the outer periphery of the outer wall of the groove and engages the groove in a snap-in manner.

Due to the engagement of the groove by the tread carrier extension substantially adapted to the groove profile, the tread carrier extension serving as a connecting element is not only supported at the inside by the inner wall but also at the outside by the outer wall of the groove of the ring. Said bilateral support avoids the formation of shearing forces when the nonskid body is loaded by a lateral force, for inst. when the user gets up, which lateral force could tear off the strongly stressed connecting elements of the tread carrier.

The extension of the tread carrier being completely embedded in the ring it is protected against impact and shock effects. Dirt and foreign bodies are kept off the internal connecting elements and penetration of snow and water into the joints at the connecting points is also inhibited thus excluding any damage or releasing of the connection due to ice formation in winter.

In an advantageous embodiment of the invention, the extension contains an outwardly directed marginal portion and a section set off thereto. The outer periphery of the marginal portion is inferior to that of the tread carrier. The marginal portion being offset relative to the outer periphery of the tread carrier, the ring and the tread carrier may have the same diameter and the outer surfaces of the ring and of the tread carrier put together may pass over into one another without an interruption. The smooth surface of the nonskid body portion periphery is important to avoid its hooking and the resultant fall down of the user of the walking aid.

The transition between the marginal portion and the offset section is advantageously of a stepwise rectangular design. The marginal portion of the tread carrier and the offset section are of about the same height. The profile of the inner face of the outer wall of the groove engaging the extension profile is correspondingly dimensioned. The marginal portion directed to the outside and the offset section of the extension are advantageous provided with a cylindrical peripheral surface.

In another advantageous embodiment, the outwardly directed marginal portion of the extension forms an oblique surface with the section offset thereto. In adaptation to the profile of the outer circumference of the extension, the outer wall of the groove extends in oblique direction, and, at its free edge, several flat peripheral channels are formed at the inner surface. The matching inclined surfaces can be easily produced. They firmly hold together to form a reliable connection between the ring and the tread carrier.

The cylindrical inner wall of the hollow extension in both embodiments abuts against the inner wall of the ring groove somewhat inclined in downward and inward direction. By the inclination in connection with the cylindrical wall surface, the extension material is pressed more strongly resulting in a better coherence of the elements.

The underside of the tread carrier contains deep grooves preferably crossing at right angles, with sharp edges and open ends towards the peripheral edge of the tread carrier, the grooves including several rows of annular segment ribs. By this kind of tread carrier profile, the antislipping quality of the nonskid body is improved for offering a better protection against aquaplaning.

In another advantageous embodiment of the invention, the tread carrier is provided with spikes fitted at at least one ring portion which is embedded in the tread carrier body. For manufacturing reasons, this type of spike fixture at a tread carrier is more economic than the mounting usual hitherto of individual pins in the thread carrier body. By embedding even only one sole ring portion in the body, a total crown of spikes is thereby connected to the body. It is also possible to integrally connect spikes to the thread carrier body, e.g. by injection molding several concentric ring portions with spikes directly during the manufacture of the body.

In another embodiment the ring portion comprises a vertical ring wall from the lower edge of which triangular points project. The ends of the points extend beyond the underside of the tread carrier body. At least one horizontal ring flange is connected to the vertical ring wall above the triangular points. The horizontal ring flange is enclosed by the material of the body and thus anchors the ring portion in thread carrier body. Several horizontal ring flanges contribute to the imrovement of the firm seat of the ring portion and prevent it from being pressed out of the body if the tread carrier is tilted with respect to the ground. Moreover, the ring flange and/or the vertical ring wall may be provided with several holes to this effect which are penetrated by the material of the body.

The ring portion conveniently has relatively thick walls for service life reasons. Further, it is favorable to have recourse to a facet-type profile at least at the inside of the triangular points and at least in the region where they project beyond the underside of the tread carrier body. The triangular points are spaced equally over the periphery of the ring portion. The vertical ring wall with the triangular points and at least one horizontal ring flange advantageously form a ring portion in one piece which may be made of hard metal.

If only one ring portion is used, it is so dimensioned that the spikes are in the outer marginal zone of the tread carrier. Several ring portions are arranged concentrically.

For the careful treatment of room floors, spikes can be covered To this effect, a cap of rubber-elastic material can be slipped over the tread carrier. At the inside of the cap bottom, at least one recess is designed to receive the ends of the triangular points. The recess suitably comprises an annular groove which facilitates the putting together of cap and tread carrier because complicated manipulations for joining a recess and an end of a triangular point are unnecessary. Prominent portions at the inside of the cap bottom support the underside of the tread carrier body so as to avoid the piercing of the spike points through the bottom.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 7 is a plan view from below of a tread carrier provided with spikes, FIG. 8 is a section of the tread carrier along line VIII—VIII of FIG. 7, FIG. 9 is a fragmentary perspective view of a ring portion made according to the invention, and FIG. 10 is an exploded view partly in section of a tread carrier and a cap prior to their assembly.

DETAILED DESCRIPTION

Figure 1:
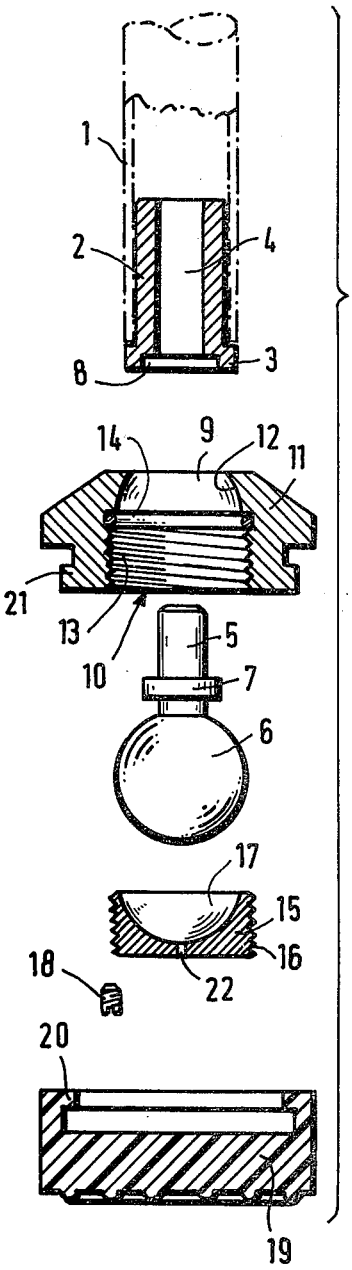
FIG. 1 is an exploded longitudinal sectional view of an embodiment of a nonskid body made in accordance with this invention.

Into the lower open end of a tubular stick 1, preferably made of metal, a connecting piece 2 is fitted which consists of a sleeve resting with a terminal flange 3 against the border of stick 1 so that it cannot slip into it. In a longitudinal opening 4 of the sleeve of the connecting piece 2, there is inserted part of a shaft in the form of a cylindrical pin 5 which shaft is integratingly formed in one part with a ball 6 made of metal or plastics. Near the ball 6, however at a distance thereto, the pin 5 is provided with an annular collar 7 which is introduced into an annular enlargement 8 at the lower end of the opening 4 of the connecting piece 2.

The pin 5 extends through the reduced end 9 of the central opening 10 of a ring 11 which can be also made of metal or plastics. Within the range of the reduced end 9 the inner surface of central opening 10 is designed as a sectional ball cup profile 12 to be adapted to ball 6. The axial continuation of said profile 12 of the central opening 10 is fitted with an internal thread 13 which extends to the end of the central opening 10. At the boundary between the profile 12 and the internal thread 13 a rubber-elastic sealing ring 14 is inserted in a groove. At the reduced end 9 the diameter of the central opening 10 of ring 11 is somewhat superior to the annular collar 7 of pin 5 thus permitting its passage through the ring 11.

Figure 2:
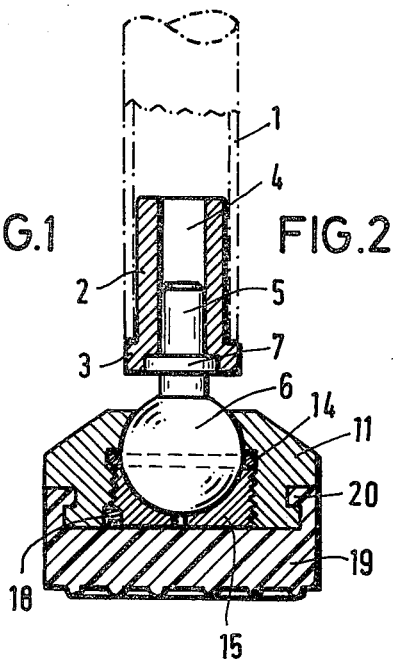
FIG. 2 is a longitudinal sectional view of the assembled nonskid body according to FIG. 1.

From below a plug is mounted into the central opening 10 by means of an external thread 16 which is screwed with the internal thread 13. The plug 15 preferably consists of a self-lubricating material, and at the surface facing the reduced end 9 of the central opening 10 it has a concave sectional ball cup profile 17 having a radius of arch which substantially corresponds to that of ball 6. The underside of the plug 15 screwed in the central opening 10 is in alignment with the underside of ring 11 (FIG. 2), and the plug is secured against turning out by means of a setscrew 18.

The inwardly directed edge 20 of a cap-shaped tread carrier 19 overengages an edge flange 21 of ring 11 to form in common with the ring 11 the nonskid body having a smooth cylindrical external surface which, via the ball 6 is hinge-connected with stick 1.

A lubrication opening 22 in the bottom of the plug 15 permits a lubrication of the ball 6 unless the plug 15 is of self-lubricating material.

Figure 3:
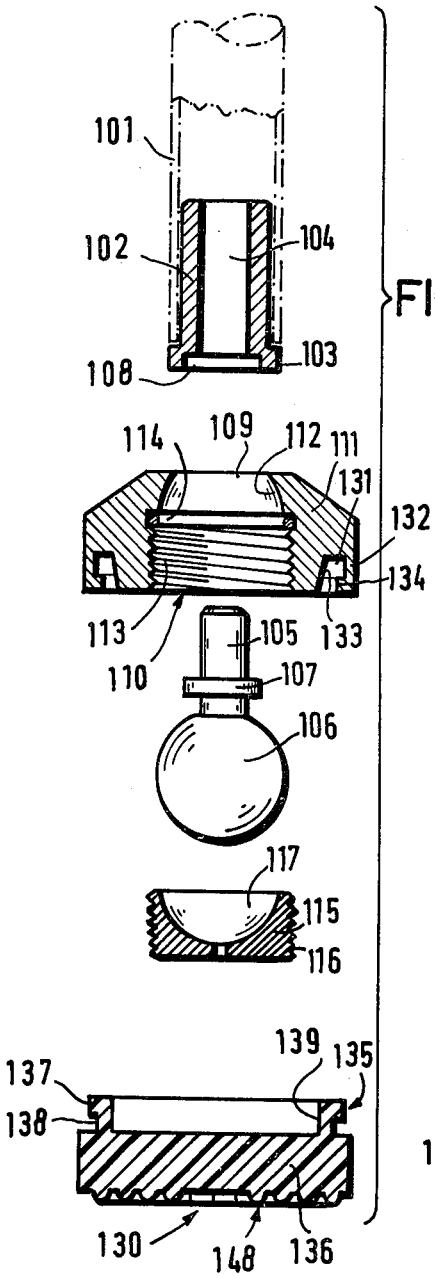
FIG. 3 is an exploded sectional view of another embodiment of the nonskid body of this invention.
Figure 4:
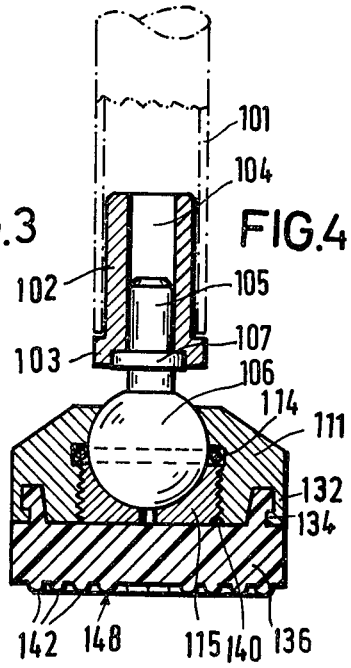
FIG. 4 is a sectional view of the assembled nonskid body of FIG. 3.
Figure 5:
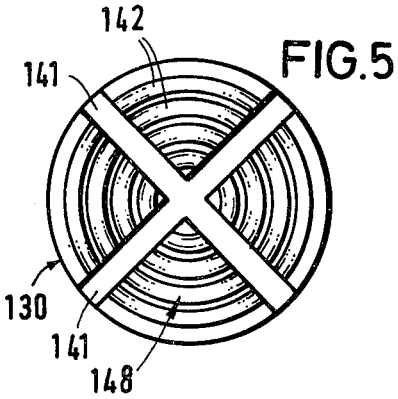
FIG. 5 is a plan view from below of the tread carrier of FIGS. 3 and 4.

According to the Example shown in FIGS. 3 to 5, a stick connecting piece 102 preferably made of metal is inserted to fit into the lower open end of a tubular stick 101, the mentioned piece consisting of a sleeve having a terminal flange 103 which rests against the edge of stick 101 so that it cannot slip into it. In a longitudinal opening 104 of the sleeve of the stick connecting piece 102, there is inserted part of a cylindrical pin 105 which is integratingly formed to a ball 106 of metal preferably of brass. Near the ball 106, however at a distance thereto, an annular collar 107 is provided at the pin 105 and introduced into an annular enlargement 108 at the lower end of the opening 104 of the stick connecting piece 102. The pin 105 extends through the reduced end 109 of the central opening 110 of a ring 111 which may be made of harder plastics.

At the reduced end 109 the internal surface 112 of the central opening 110 is adapted to a belt zone of ball 106. The axial continuation of said internal surface 112 of the central opening 110 is provided with an internal thread 113 extending to the end of the central opening 110. At the boundary between the internal surface 112 and the internal thread 113 a rubber-elastic sealing ring 114 is fitted in a groove. The diameter of the reduced end 109 of the central opening 110 of the ring 111 is somewhat superior to the annular collar 107 of the pin 105 thus permitting to pass the latter through said reduced end.

A plug 115 is mounted from below in the central opening 110 and screwed by means of an external thread 116 with the internal thread 113. The plug 115 preferably consists of a self-lubricating material and at the surface facing the reduced end 109 of the central opening 110, it is provided with a concave ball cup curvature 117 whose radius of arch substantially corresponds to that of the ball 106. The underside of the plug 115 screwed in the central opening 110 is in alignment with the bottom of the ring 111 (FIG. 4) and the plug 115 is protected from turning out by means of a welding point 140.

In this example a groove 131 all around in the bottom of the ring 111 is open downwardly and limited by an outer wall 132 as well as by an inner wall 133. The inner wall 133 extends from the top to the bottom with a slight inward inclination while the internal surface of the outer wall 133 is of a stepped cylindrical shape. It comprises an edge flange 134 projecting at a right angle from the internal surface of the outer wall 132.

The groove 131 is meant to receive a profiled axial extension 135 of a tread carrier 130, which extension has an outer diameter inferior to the body 136 of the tread carrier 130. It comprisses a marginal portion 137 directed outwardly and a section 138 offset thereto. The marginal portion 137 and the section 138 are substantially of the same height. Their dimensions are adapted to the profile of the outer wall 132 of the groove 131.

If the extension 135 engages the groove 131, the inclined surface of the inner wall 133 of the groove slightly compresses the cylindrical internal wall 139 of the hollow extension 135 thus improving the engagement between the connecting profiles 134 and 137. The outer diameter of the section 138 of the extension 135 being inferior to the outer periphery of the body 136 of the tread carrier, the dimensions of the outer periphery of the body 136 and of the ring 111 may be equal thus resulting in a peripheral continuous surface of the total nonskid body. The tread 148 of the tread carrier 130 contains two relatively deep U-shaped grooves 141 crossing at right angles and having open ends at the periphery of the tread carrier (130) (FIG. 5). Between them there are provided four rows of four ring segment ribs 142 each. The edges of the grooves 141 are sharp to avoid aquaplaning and to improve the nonskid effect of the nonskid body.

Figure 6:
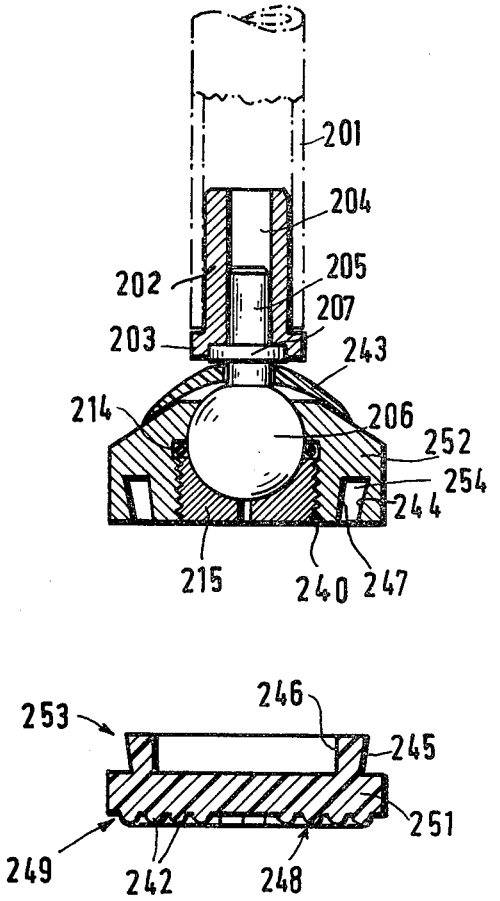
FIG. 6 is an exploded sectional view of a nonskid body with modified connection profile between ring and tread carrier.

In the Example of FIG. 6 a ball 206 is introduced into the central opening of a ring 252, which ball is maintained in its position by a screwed plug 215 secured by a welding point 240. Within the region of its greatest periphery the ball 206 is surrounded by a sealing ring 214. It is fitted with a pin 205 whose annular collar 207 is inserted in an enlargement of a sleeve 202 to project into its longitudinal opening 204. At the lower end of the sleeve 202, a terminal flange 203 abuts against the edge of the stick 201 in alignment therewith.

The connecting elements between the tread carrier 249 and the ring 252 consist of an outer inclined surface 245 of an extension 253 of the tread carrier 249 and an adapted inclined surface 244 in the outer wall of the groove 254 of ring 252. The inclined surface 245 extends from the outside at the top to the inside at the bottom. The inner wall 246 of the extension 253 is cylindrical, while the inner wall 247 of the groove 354 extends downwardly at an inclination to the inside. By the cooperation of the wedge 244 and the counterwedge 245 as well as of the surfaces 246,247 the resultant connection of the elements 249 and 252 is solid. The tread 248 of the body 251 of the tread carrier 249 is provided with a profile similar to that of the tread 148 of the body 136 of the Example according to FIGS. 3 to 5.

Above the reduced end of the central opening of ring 252, through which projects the pin 205, there is fitted an arched annular packing 243 of rubber-elastic material. Its cross section is key-shaped with an increasing flattening portion towards its outer edge. The annular packing 243 moves together with the pin 205 and practically excludes the penetration of dirt etc. into the ball joint casing. The annular collar 207 at the pin 205 prevents the upward slipping of the annular packing 243.

The annular packing 243 can be also used with the nonskid bodies of FIGS. 1 to 4.

The tread carrier 300 of FIGS. 7 to 10 containing spikes may replace the tread carrier 130 of the Examples of FIGS. 3–5. The spikes ensure an improved nonslipping effect on a slippery, frozen ground.

The tread carrier 300 substantially consists of a body 302 made of rubber-elastic material and of a ring portion 303 of a hard metal embedded in the body. A marginal section 304 directed to the outside and a section 305 offset stepwise thereto of a hollow extension 306 of the body 302 serve for connecting the tread carrier 300 with the ring 111 according to FIGS. 3–5. The underside of the body 302 is profiled by several concentric rows of annular ribs 307 which are divided into four circular sectors by means of two relatively deep and broad grooves 308 crossing at right angles. The grooves 308 are deeper than the height of the annular ribs 307. Their edges are sharp and their ends are open at the periphery of the body 302.

The ring portion 303 is made of one metal part. It consists of a vertical ring wall 309 from the lower edge of which, points 313 situated in the plane of the ring wall 309 are projecting and at the upper edge of which an upper horizontal ring flange directed inwardly is joined below which a second horizontal ring flange 311 preferabbly somewhat shorter is present. In the upper ring flange 310, several holes 312 are fitted which are penetrated by the material of the body 302 and which, in common with the second ring flange 311, contribute to an improved anchorage of the ring portion 303 in the body 302. It is advantageous for the body 302 to be produced by injection molding and at the same time, the ring portion 303 is embedded in it. The eight straightly downward directed triangular points 313 projecting from the lower edge of the ring wall 309 of the ring portion 303 form one piece with the ring wall 309. The outer surfaces of the ring wall 309 and the triangular points 313 change over into one another in alignment and are smooth or grooved, if necessary. The internal surface of the ring wall 309 is also smooth, while the inside of the triangular points 313 is of a facet-like tapered profile, in particular ground. The broad base of the triangular points 313 is enclosed by the material of the body 302 and only the pointed ends extend beyond the profiled underside of the body 302 to form the spikes 301.

A cap 314 can be slipped over the tread carrier 300 (FIG. 10) to cover the spikes 301 so as to treat carefully the room floors. At the inside of the bottom 315 of the cap 314, there is an annular groove 316 to receive the spikes 301. The apexes of the annular ribs 307 firmly abut against the upwardly directed bottom 317 of the cap 314 thus, in case of a loaded nonskid body, preventing the points of the spikes 301 from penetrating downwardly through the cap 314. Advantageously, the underside 318 of the cap 314 is profiled in corresponding to the underside of the tread carrier 300 thus ensuring, with covered spikes 301, also an antislipping effect and a protection against aquaplaning.

While the nonskid body for the stick of a walking aid has been shown and described in detail, it is obvious that this invention is not to be considered as being limited to the exact form disclosed, and that changes in detail and construction may be made therein within the scope of the invention, without departing from the spirit thereof.

What is claimed is:

1. A nonskid assembly comprising:

(a) a ring element having an upper portion and a lower undersurface with central opening passage extending from the undersurface completely through the ring element, (b) coupling means partially disposed within said central opening passage and projecting outwardly from said central opening, (c) retainer means disposed within the central opening passage through said lower undersurface, (d) said retainer means being effective to support said coupling means against downward displacement within the central opening passage, (e) tread carrier means having treads on a bottom surface thereon being connected to the ring element over the lower undersurface of said ring element, and (f) the retainer means has a plane underside against which the tread carrier means is disposed.

2. A nonskid body assembly as defined in claim 1 wherein said retainer means is threadedly engaged within said central opening passage.

3. A nonskid body assembly as defined in claim 1 wherein said retainer means is fixedly bonded within said central opening passage.

4. A nonskid body assembly as defined in claim 1 wherein said retainer means includes an axial opening for feeding lubricant to said coupling means within said central opening passage.

5. A nonskid body assembly as defined in claim 1 wherein said retainer means is composed of self-lubricating material.

6. A nonskid assembly as defined in claim 1 wherein said coupling means includes a ball and a shaft rigidly connected thereto, the central opening passage terminating at the upper surface of the ring element in a first semi-spherical cup which is complementary to said ball, and said retainer means has a second semi-spherical cup which together with said first semi-spherical cup forms a housing for said ball.

7. A nonskid body assembly as defined in claim 6 wherein said central opening passage includes an annular groove containing resilient sealing means therein adjacent the first semi-circular cup.

8. A nonskid body assembly as defined in claim 6 wherein a protective cover is disposed over the upper portion of the ring element and surrounds the shaft of the coupling means, said protective cover having an effective size and configuration to exclude any foreign material from entering the central passage opening containing the ball of the coupling means.

9. A nonskid body assembly as defined in claim 1 wherein the threads include at least one channel passing through the center thereof, said channel opening toward the peripheral edge of the tread carrier means, and having sharp edges and plural rows of circular grooves intersecting said channel.

10. A nonskid body assembly as defined in claim 9 wherein two channels cross one another at right angles and have a greater depth than said circular grooves.

11. A nonskid body assembly as defined in claim 1 wherein said ring element and said tread carrier means have identical diameters and, when joined, form a continuous outer surface extending from said ring element to said tread carrier means.

12. A nonskid body assembly as defined in claim 1 wherein the ring element includes an edge flange radially and outwardly extending from the outer periphery of said ring element, the periphery of said tread carrier means includes an annular lip portion extending inwardly, and said edge flange and said annular lip portion have complementary dimension to frictionally grip one another.

13. A nonskid body assembly as defined in claim 1 wherein the lower surface of said ring element includes an annular groove having an inner wall, an outer wall and a bottom wall, the tread carrier means includes a male extension element vertically extending therefrom as a complementary configuration with respect to the annular groove for frictional engagement therewith.

14. A nonskid body assembly as defined in claim 13 wherein said annular groove includes first flange transversely and inwardly extending from the outer wall, said male extension element includes a recess and second flange transversely and outwardly extending therefrom for slipping into said annular groove.

15. A nonskid body assembly as defined in claim 14 wherein the inner wall of said annular groove is inclined outwardly thereby increasing the width of said groove as moved away from the bottom wall, a major portion of said annular groove has a width smaller than the thickness of said male extension element so that firm frictional engagement is produced between said ring element and said tread carrier means.

16. A nonskid body assembly as defined in claim 14 wherein said second flange and said recess have cylindrical peripheral surfaces.

17. A nonskid body assembly as defined in claim 16 wherein
the transition between said recess and said second flange is of stepwise configuration disposed at a 90° angle.

18. A nonskid body assembly as defined in claim 16 wherein
said recess and said second flange have substantially the same height.

19. A nonskid body assembly as defined in claim 16 wherein
the diameter of said second flange is smaller than the diameter of said tread carrier means.

20. A nonskid body assembly as defined in claim 13 wherein
the inner and the outer walls of said annular groove are inclined towards the central opening passage of said ring element.

21. A nonskid body assembly as defined in claim 20 wherein
said male extension element includes a substantially cylindrical inner surface and an outwardly inclined outer surface, and
said male extension element is frictionally retained in said annular groove therein.

22. A nonskid body assembly as defined in claim 21 wherein
the width of said annular groove is substantially smaller than the thickness of said male extension element for a tighter grip.

23. A nonskid body assembly as defined in claim 13 wherein
the outer wall of the groove and the outer surface of the male extension are inclined and
several flat peripheral channels are located on the inner surface at the free edge of the extension.

24. A nonskid body assembly as defined in claim 6 wherein
the tread carrier means includes a spike carrier having a plurality of spikes.

25. A nonskid body assembly as defined in claim 24 wherein
said tread carrier means has a body portion,
said spike carrier includes a vertical ring wall having a lower edge from which said spikes extend outwardly from said body portion, and
at least one horizontal ring flange transversely extends from said vertical ring wall into said body portion.

26. A nonskid body assembly as defined in claim 25 wherein
said horizontal ring flange is directed inwardly.

27. A nonskid body assembly as defined in claim 25 wherein
said horizontal ring flange is directed outwardly.

28. A nonskid body portion as defined in claim 25 wherein
said horizontal ring flange includes a plurality of openings which are filled with the material of said body portion of the tread carrier means.

29. A nonskid body assembly as defined in claim 25 wherein
each said spike includes a facet-like tapered inner surface.

30. A nonskid body assembly as defined in claim 25 wherein
said spikes are peripherally spaced at equal distances around the vertical ring wall.

31. A nonskid body assembly as defined in claim 25 wherein
the vertical ring flange, the spikes and the horizontal ring flange are formed as one piece.

32. A nonskid body assembly as defined in claim 25 wherein
a plurality of concentrically disposed vertical ring flanges are embedded in said body portion of the tread carrier means.

33. A nonskid body assembly as defined in claim 25 wherein
a protective cap is disposed over said spikes and joined to said body portion of tread carrier means.

34. A nonskid body assembly as defined in claim 33 wherein
said protective cap is composed of resilient material.

35. A nonskid body assembly as defined in claim 34 wherein
said protective cap includes a continuous side wall, a bottom wall and a recess to receive the end of each of the spikes, and
the depth of the recess is greater than the length of the spikes.

36. A nonskid body assembly as defined in claim 35 wherein
the recess is defined as a continuous annular channel to receive said spikes.

37. A nonskid body assembly as defined in claim 1 wherein
the assembly is adapted to be carried by an elongated support body on the item to which the assembly is to be connected,
a connecting piece has a bore and a structural configuration effective to fit the elongated support body, and
the coupling means includes a shaft having a structural configuration to fit into the bore of the connecting piece when the connecting piece is fitted to the elongated support body.

38. A nonskid body assembly as defined in claim 6 wherein
the plane underside of the retainer means extends in alignment with the underside of the ring element to form a coextensive undersurface against which the tread carrier means is disposed.

* * * * *